US005799446A

United States Patent [19]

Tamlyn

[11] Patent Number: 5,799,446

[45] Date of Patent: Sep. 1, 1998

[54] SOFFIT CONSTRUCTION FOR IMPROVED EAVE CONSTRUCTION

[76] Inventor: John Thomas Tamlyn, 10406 Cash Rd., Stafford, Tex. 77477-4492

[21] Appl. No.: 852,632

[22] Filed: May 7, 1997

[51] Int. Cl.[6] ..... E04B 7/00

[52] U.S. Cl. ..... 52/94; 52/95; 52/302.1

[58] Field of Search ..... 52/94, 95, 96, 52/459, 460, 468, 302.1

[56] References Cited

U.S. PATENT DOCUMENTS

| | | | |
|---|---|---|---|
| 4,195,455 | 4/1980 | Chalmers et al. | 52/94 |
| 4,461,128 | 7/1984 | Knoebl | 52/94 |
| 4,580,374 | 4/1986 | Quinell | 52/95 |

FOREIGN PATENT DOCUMENTS

| | | | |
|---|---|---|---|
| 159932 | 11/1954 | Australia | 52/459 |
| 85739 | 9/1952 | Denmark | 52/459 |

*Primary Examiner*—Creighton Smith

*Attorney, Agent, or Firm*—Gunn & Associates, P.C.

[57] ABSTRACT

The present disclosure is directed to a soffit assembly made of inside and outside soffit boards, each comprising two or more serially arranged boards. When assembled, the inside and outside soffit boards define a central gap closed by a vent strip having perforations there along to enable breathing through said vent strip; the vent strip also icludes left and right U-shaped receptacles to enable the vent strip to snap to the adjacent soffit boards. A cross strip is also set forth which has a H-shape in profile to enable the adjacent boards to be abutted against each other and thereby joined with said cross strip at the joint between the boards.

24 Claims, 1 Drawing Sheet

SOFFIT CONSTRUCTION FOR IMPROVED EAVE CONSTRUCTION

BACKGROUND OF THE INVENTION

This disclosure is directed to a new construction for soffits which are installed under the eaves in residential housing. In the construction of a residential house, the rafters and joists positioned above the house define an attic space which is ventilated by circulation in the attic area. While there are turbine ventilators installed on the roof eave vents, gable louvers and other devices to exhaust hot air from an attic, an equally important aspect of attic circulation is obtained by intake air movement through the soffit. The soffit is the region under the eave which is normally closed. In the past, they have been closed by thin boards such as ½" or ¾" boards. One improvement in the soffit has been the incorporation of gaps in the soffit which are closed by screen wire. An even larger improvement has been implemented in the past such as positioning a plastic strip over the gap in the soffit. The plastic strip is typically perforated to provide breathing. Over time, the availability of wood which readily accepts either small nails or staples has decreased Particle board and other composite materials have been substituted. This makes a better, longer lasting soffit in the sense that the composite board is typically more weather resistant and less likely to rot or decay with time. Even better products have been provided for that which have even longer life when exposed to weather. One such device is a fiber-cement soffit board. Fiber-cement is a material which provides a low maintenance product which is not combustible, is moisture resistant, will not rot, and is not susceptible to insect attack by termites. It is a quality product and is able to replace wood without warping, rotting or bending over a 50 year life. One maker of this product provides a 50 year warranty. There are difficulties, however, with fiber-cement boards. It is not readily possible to drive a nail, staple or screw through such a board and develop a grip between the nail and baord. It is also difficult to make a staple hold permanently. Therefore, the soffit board formed of fiber-cement is not so readily integrated in the structure. To install a breathing strip next to such a soffit board, and especially one made of fiber-cement, it is easier to install a clip mechanism. This avoids the necessity of finding a rafter on the blind side of the fiber-cement board and driving a nail through the fiber-cement soffit board and then into the rafter. Moreover, the apparatus of the present disclosure enables construction of a soffit under the eave of any length and width deemed appropriate. This enables consecutive boards to be anchored under the eave to extend the eave to any length, for instance, 50' or 100' in length. In that example, the soffit is fabricated in place under the eave by placing precut fiber-cement soffit boards on the eave, defining a gap between two runs thereof, and extending the runs of soffit boards along the eave length. If, for instance, the stock boards are provided in 12' lengths, an eave of 50' will require four full-length soffit boards and a short one which is cut to size to complete the 50' length. Each soffit board is installed end to end to accumulate the 50' length. A 50' gap between two parallel soffit boards is created. For easy nomenclature, the two soffit boards are defined simply as the inside and outside soffit boards. The inside soffit board is adjacent to the wall of the building while the outside soffit board is parallel but more remote to the inside soffit board. The gap between the two is the breathing space.

Normally, the inside and outside soffit boards are butted together to define the length of the soffit board. The butt joint is not a load bearing joint but it typically is not an easily sealed joint. Rather, it is simply the butt located gap between one board and another. Heretofore, it has been necessary to plug that gap. A common technique for doing this is injecting a semisoft adhesive into the gap with a caulking gun. The caulking material is pumped into the gap and cures somewhat to provide a tacky or adhesive seam material.

The caulking material prevents air flow in that area and also seals out moisture, insects, etc. It is not a load transferring joinder material. It simply plugs the gap between the butt ends of adjacent boards. Moreover, the caulking material pumped into the gap accommodates misalignment readily within a range. Misalignment and gapping which might arise by settling of the house, however, may pose a problem. Where the gap becomes smaller, the caulking material can stay put. Where the gap is pulled wider, over time, the caulking material may fail. Where the gap is irregular, the caulking material may provide an adequate seal where the gap is narrow but an inadequate seal where the gap is wider. Caulking material is initially soft and can be worked easily. Over the years, it dries and cracks with aging and drying. This time dependent deterioration is detrimental to the use of caulking.

In the past, prefabricated soffit breathing strips of aluminum wire screen and surrounding rectangular frames have been attached by nailing or stapling. One advantage of aluminum is that it forms a protective oxide layer, avoiding the need of painting or putting some sort of protective coating on it. In this instance, direct contact of aluminum to the cement based products seems to create some sort of undesired reaction at the contact area. While no chemical analysis has been made it seems to form a localized skin blemish on the cement based board on wall covering product.

It is desirable that the completed soffit are be made substantially without requiring a lot of measurements. The present apparatus sets out a system by which this can be accomplished. The breathing space under the eave is assured through the use of the present disclosure. This disclosure thus sets forth a fabricated soffit assembly which is made in place. It features an inside soffit board formed of two or more lengths of soffit board material. While wood (more often, plywood) is one embodiment, the present invention especially contemplates the use of improved soffit products including particle board but especially also including fiber-cement soffit panels. Again, while it will work successfully even with plywood or other nonwood members, it finds its ultimate and best mode of assembly and greatest life in making the soffit with fiber-cement products. So, it is best described as a soffit assembly having an inside soffit board made up of two or more butt joined boards, an intermediate gap which is the breathing space, and the outside soffit board which is assembled in the same fashion as the inside soffit board. The present invention further contemplates the installation of an elongate strip between the inside and outside soffit boards. It clips to the adjacent soffit boards. There are left and right edge located U-shaped receptacles along the length of the vent strip. The vent strip spans the open gap and is wider than it, thereby snapping in place and requires no nails or staples to maintain the installed position. A cross strip is installed at the end of individual soffit boards. The cross strip has a H-shaped profile, and is installed across the width. The cross strip thus provides continuity, replacing the caulking and caulking gun, and thereby closing the attic space to assure that controlled ventilation is achieved through the soffit assembly of the present disclosure. Moreover, it can be installed and left in position for the duration or life of the building. The finished installation features aesthetically attractive seams.

Summarizing the present invention, it comprises an assembled soffit under an eave which is made of an inside soffit board and an outside soffit board, and each of the two is preferably assembled from composite materials having the form of sheet or decking material and extending to any desired length. The length is accommodated by installing two or more boards serially. A central gap is left and is filled by a vent strip, to be described, which snaps in place. A cross strip is also installed at the ends of individual soffit boards to protect at that joint. The vent strip and cross strip are fabricated as extrusions and are relatively inexpensive, easy to manufacture, durable when installed, can be installed with a minimum of hand labor and do not require the use of screws, bolts, nails, staples or other fasteners.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

DETAILED DESCRIPTION OF THE PREFERRED EMBODIMENT

Figure 1:
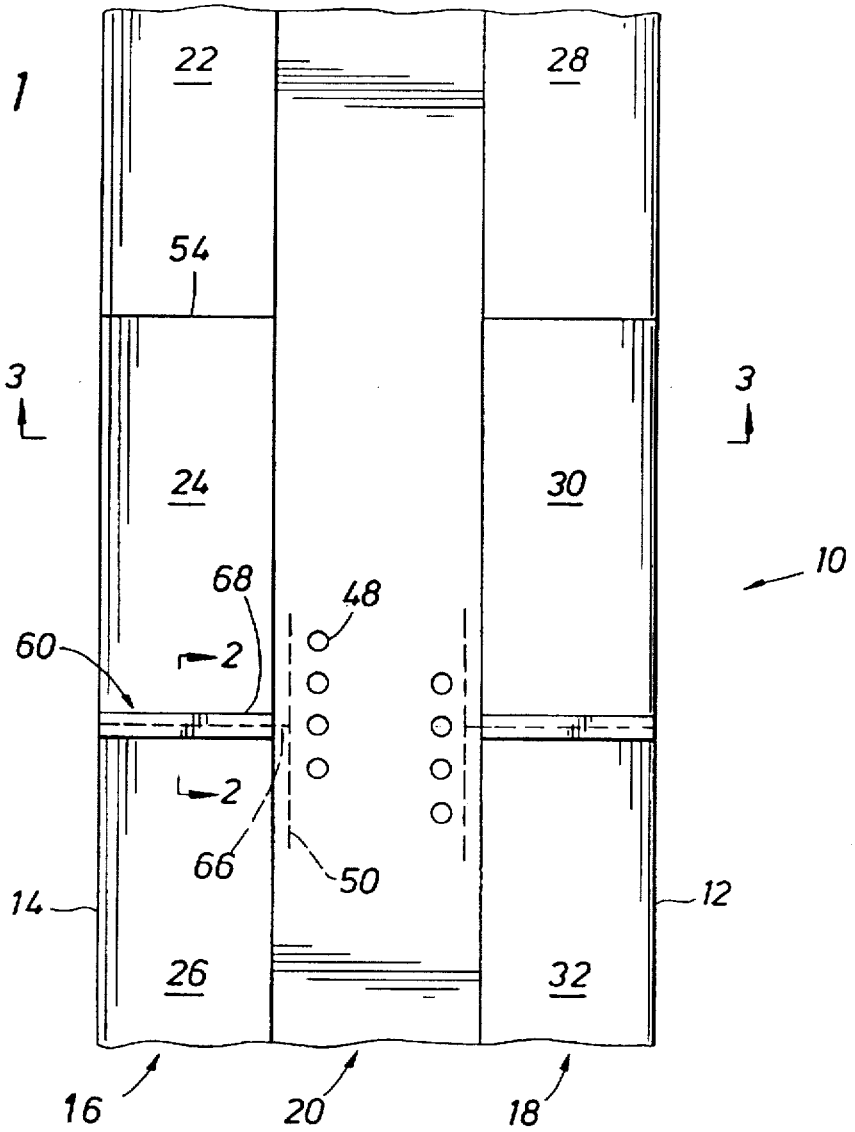
FIG. 1 is a bottom view of a soffit looking up at the soffit and showing parallel inside and outside soffit boards defining a gap therebetween wherein a vent strip is installed in the gap to provide breathing into the attic.

Attention is now directed to FIG. 1 of the drawings where the context will be defined first and then the soffit assembly will be set forth. FIG. 1 is a view looking upwardly under the eave of a residential house to show the soffit in that region. The fabricated assembly show in FIG. 1 can be built in place during house construction. Accordingly, the numeral 10 identifies the soffit assembly of FIG. 1. The soffit assembly 10 can have any typical width, common widths being in the range of about 8" on up to about 24". It can be different but there are normally practical limitations on the width. Whether wider or narrow, the soffit assembly 10 is located under the eave and has a length equal to the length of the wall of the house or structure. In residential construction, it is not uncommon to assemble a soffit assembly as long as 100'. It can as short as one or two feet. The length is normally limited at the lower end by practical considerations, for example, an eave of only two feet in length is usually not constructed. Going further with FIG. 1, the edge 12 defines the outer edge of the eave and is typically planked with a facia strip (discussed elsewhere) and is normally parallel to the wall. The wall is located along the edge 14 on the opposite side. The wall can be of any typical construction including a rectangular framing system supporting sheet rock with external planking or some other form of wall covering. If planked, the house will then present a wood exterior. Otherwise, it can be covered on the exterior with brick or other construction materials including stucco, cedar shingles, etc. Accordingly, the edge 14 defines the edge adjacent to the wall.

Assume for easy discussion that the soffit assembly 10 is 16" wide and 50' long. It is assembled in place by fastening to the underside of the rafter and ceiling joists which span the house. The house is constructed with regularly and evenly spaced rafters and joists. They are used to nail into and thereby anchor the several boards that make up the soffit assembly 10.

The inside soffit board is indicated by the numeral 16 and it is parallel to the outside soffit board 18. They are equal length and equal width in most installations although that is an elective matter and they may be unequal in width. In this particular instance, in making a 16" wide soffit assembly 10, assume for purposes of illustration that the inside and outside soffit boards are equal in width and are 6". Assume also that the gap between the two is 4" so that the vent strip must cover that gap and is somewhat wider as will be given in specific detail below. These dimensions are representative. It is just as readily possible to make the vent strip in smaller widths such as 2".

The vent strip 20 is clipped between the inside and outside soffit boards 16 and 18. It can be supplied in any length. Common lengths are about 8' although it can be made longer or shorter. If longer, it can simply be cut transversely to a specified length.

A carpenter fabricates the soffit assembly 10 under the eave in place during house construction. At the appropriate time in the construction of the house, the soffit assembly is built by first installing the inside soffit board 16. A first section or length 22 is anchored against the joist and wall with nails or staples. Where it is made of fiber-cement, it is necessary to drive the nails or staples into wood on the opposite side to assure that the nail or staple is grasped adequately. The board 22 has a typical thickness of about ¼" to about ½". Where it is wood, it will typically be planed to some industry standard profile. If made of composite materials such as particle board or plywood or fiber-cement, it is made to a specified thickness, typically between ¼" and ½". The board 22 is attached in place and the next board 24 is also anchored in place. A third board 26 is then anchored in place. This can be extended to obtain the necessary full length of the soffit assembly 10. Either thereafter or simultaneously, the outside soffit boards 28, 30 and 32 are installed. They define a gap between the inside and outside soffit boards which is relatively consistent to enable the vent strip 20 to be installed.

Figure 3:
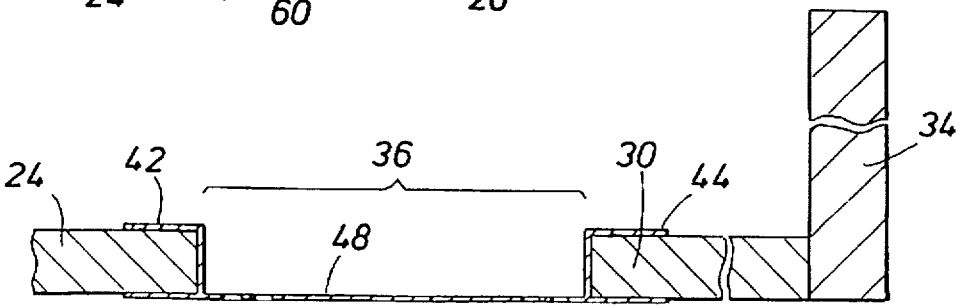
FIG. 3 is a sectional view along the line 3—3 of FIG. 1 and further illustrates details of construction of the assembled soffit and the bent strip which permits breathing of the attic space.

The vent strip is better shown in the sectional view of FIG. 3. This view shows the soffit boards 24 and 30 in sectional view. It also illustrates the facia strip 34 on the exterior. The strip 34 is shown in an upright position and it extends up to the roof which has been omitted from FIG. 3. There is a defined gap generally indicated by the numeral 36 which is the gap between the two soffit boards defining the air breathing space into the attic. The gap 36 extends along the full length of the soffit assembly. The gap is defined by the edges of the soffit boards 24 and 30. They are preferably equal in thickness. While they could be different, there is not particular gain in providing different thicknesses to them.

The soffit boards 24 and 30 are then engaged with the vent strip 20. The vent strip is constructed with an exposed lower face 40 shown in FIG. 3. There is a left side U-shaped receptacle 42 which is defined by three mutually perpendicular walls. There is a right side U-shaped receptacle 44 of similar construction but facing in the opposite direction.

Each of the receptacles 42 and 44 is defined by the three sides. They are sized so that they clip to the soffit boards 24 and 30. In that regard, if the boards are fabricated with a nominal ½" thickness, then the receptacles 42 and 44 are made with matching receptacle throat width. The receptacles 42 and 44 are integrally constructed with the strip vent material 20. It is extruded in the cross-sectional profile shown in FIG. 3. It is preferably formed of vinyl with sufficient stiffness so that it holds its shape. Moreover, a typical thickness is about 3 to about 8 mils, and it is extruded to that thickness with an integral dye material so that it has a uniform color on both faces and throughout. The color pigment is typically white, cream, tan and the like. The extruded vent strip 20 is provided with a relatively uniform set of perforations 48 which define breathing spaced or openings. This enables ventilation into the attic area.

Returning now to FIG. 1 of the drawings, it will be observed that the receptacles 42 and 44 lap over the edges of the inside and outside soffit boards. The dotted line representation 50 shows the measure of overlap. That is defined by the depth of the receptacle along the edges. This assures adequate locking of the strip 20 to the board so that the strip can simply be inserted into its place. Returning again to the fabrication of the system, the vent strip 20 is installed by temporarily bowling or buckling it so that the edges of the boards are clamped first along one edge and then the second edge. The vent strip 20 can be snapped into place in just a few seconds.

Continuing, however, with the description, there is a cross strip that is between the ends of adjacent boards. The cross strip 60 is included to seal the gap between the ends of adjacent boards 24 and 26. It is preferably installed at every transverse open seam where caulking would otherwise be required. For instance, an open seam 54 is shown in FIG. 1 which would otherwise require caulking but a cross strip segment 60 is placed there to close up that gap.

Figure 2:
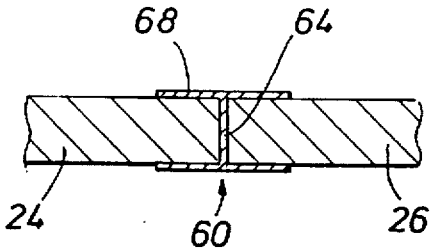
FIG. 2 is a sectional view along the line 2—2 in FIG. 1 and shows an installed transverse cross strip at a butt joint.

Attention is now directed to FIG. 2 of the drawings where the boards 24 and 26 are illustrated. They define a butt joint as illustrated but that joint is closed by the cross strip 60. The cross strip has a H-shaped profile and is extruded so that it has left and right receptacles with only the web material 64 therebetween. The boards 24 and 26 are assembled sequentially with the cross strip placed between the two before the last board is nailed in place. Assume that the soffit assembly 10 is built from the top of FIG. 1 proceeding toward the bottom. The board 22 will be nailed in place. The cross strip segment 60 will then be positioned at the gap 54 and then the board 24 is nailed in place. This permits the boards 22 and 24 to be moved against each other, clamping the cross strip 60 between the two prior to nailing. Nailing of the second board locks the cross strip in place. The cross strip 60 has a construction similar to the receptacles 42 and 44 except the webbing 64 between them is relatively thin. Again, it can be extruded and made of vinyl to about the same thickness with the same color pigment in it. It is preferably cut to length prior to installation on the boards 24 and 26. Since the nominal width of the boards 24 and 26 is well known, a simple cutting tool can be used to cut the cross strip material 60 into a number of short lengths to enable the cross strip 60 to be placed between adjacent boards. The common depth or throat on both of the cross strip material 60 and the vent strip 20 may position both so that nay overlap (at 90° angles) is not desirable. This overlap problem can be easily solved by cutting away a part of either. To illustrate, assume that dimensional control of the board, strip 20 and strip 60 is sharply maintained. In that instance it may be desirable to trim away the end of the strip 60 on both the hidden side and the exposed side. This is exemplified in FIG. 1 where the dotted line 66 represents and end position cut away so the webbing 64 can continue to be full length while the exposed face 68 is cut shorter.

Going back now to the manufacture of the soffit assembly 10, it is preferably put together by a carpenter working under the eaves of the house during construction. It is typically installed after the wall at the edge 14 is substantially completed. It can be put on before or after the wall is painted or other wall finish layers are applied.

While the foregoing is directed to the preferred embodiment, the scope thereof is determined by the claims which follow.

I claim:

1. A soffit assembly under an eave of a roof overhang on a building comprising:

(a) an elongate inside soffit board formed of two or more boards serially affixed along an outside wall of the building;

(b) an outside soffit board parallel to the inside soffit board and comprised of two or more boards parallel to and spaced from the inside board;

(c) wherein said inside and outside soffit boards define a gap therebetween having a specified length corresponding to the length of the outside wall; and (d) a vent strip extending the full length of said inside and outside soffit boards wherein said vent strip (i) has board engaging means along parallel edges of said vent strip enabling engagement with said inside and outside soffit boards, (ii) enables air circulation therethrough into a space above said vent strip, and (iii) is temporarily bowed for engagement with said inside and outside soffit boards.

2. The apparatus of claim 1 wherein said vent strip is constructed with a board engaging means comprising an edge located U-shaped receptacle.

3. The apparatus of claim 2 wherein said U-shaped receptacle has a length equal to that of said vent strip.

4. The apparatus of claim 3 wherein each of said parallel edges supports receptacles therealong to enable releasable engagement with said inside and outside soffit boards.

5. The apparatus of claim 4 wherein said vent strip has a uniform cross-sectional profile along the length thereof and is formed of an extruded vinyl material.

6. The apparatus of claim 4 wherein said vent strip has symmetrical left and right receptacles therealong said parallel edges and said receptacles have U-shaped openings therein to releasably engage the edges of said inside and outside soffit boards.

7. The apparatus of claim 1 wherein said inside soffit board is formed of two or more joints which form a butt joint and said butt joint supports an H-shaped cross strip having left and right receptacles therein engaging the boards of said inside soffit board.

8. The apparatus of claim 7 wherein said outside soffit board is formed of two or more joints which form a butt joint and said butt joint supports an H-shaped cross strip having left and right receptacles therein engaging the boards of said outside soffit board.

9. The apparatus of claim 8 wherein said cross strip has receptacles having a thickness sized to accommodate the thickness of boards comprising said inside soffit board.

10. The apparatus of claim 9 wherein said cross strip has receptacles having a thickness sized to accommodate the thickness of boards comprising said outside soffit board.

11. A soffit assembly under an eave of a roof overhang on a building comprising:

(a) an elongate inside soffit board formed of two or more boards serially affixed along an outside wall of the building;

(b) an outside soffit board parallel to the inside soffit board and comprised of two or more boards parallel to and spaced from the inside board;

(c) wherein said inside and outside soffit boards define a gap therebetween having a length up to the length of the outside wall and a continuous vent strip is located between said inside and outside soffit boards wherein said vent strip (i) enables air circulation therethrough into a space above said vent strip, (ii) has board engaging means along parallel edges of said vent strip enabling engagement with said inside and outside soffit boards, and is cut to the gap length, and (iii) is temporarily bowed for engagement with said inside and outside soffit boards; and (d) a cross strip positively engaging first and second boards comprising said inside soffit board.

12. The apparatus of claim 11 wherein said board engaging means of said vent strip is constructed with an edge located U-shaped receptacle for positioning said vent strip.

13. The apparatus of claim 12 wherein said U-shaped receptacle has a length equal to that of said vent strip.

14. The apparatus of claim 13 wherein each of said edges supports receptacles therealong to enable releasable engagement with said inside and outside soffit boards.

15. The apparatus of claim 14 wherein said vent strip has a uniform cross-sectional profile along the length thereof and is formed of an extruded vinyl material.

16. The apparatus of claim 14 wherein said vent strip has symmetrical left and right receptacles therealong said parallel edges and said receptacles have U-shaped openings therein to releasably engage the edges of said inside and outside soffit boards.

17. The apparatus of claim 11 wherein said inside soffit board is formed of two or more joints which form a butt joint and said butt joint is engaged with a H-shaped cross strip having left and right receptacles therein engaging the boards of said inside soffit board.

18. The apparatus of claim 12 wherein said outside soffit board is formed of two or more joints which form a butt joint and said butt joint supports an H-shaped cross strip having left and right receptacles therein engaging the boards of said outside soffit board.

19. The apparatus of claim 18 wherein said cross strip has receptacles having a thickness sized to accommodate the thickness of boards comprising said inside soffit board.

20. The apparatus of claim 19 wherein said cross strip has receptacles having a thickness sized to accommodate the thickness of boards comprising said outside soffit board.

21. A method of constructing a soffit to provide ventilation through the soffit into the attic space thereabove wherein the soffit is constructed beneath an overhanging eave and comprises the steps of:

(a) placing a soffit board under an eave extending along a vertical wall, wherein the soffit board has a first exposed edge;

(b) positioning a second soffit board parallel to the first board wherein said first and second boards define a space therebetween at the edges of said boards;

(c) closing the space between the first and second boards with a perforated sheet defining, in the aggregate, an air flow space through perforations in said sheet into the attic area above said first and second boards; and (d) wherein said sheet incorporates first and second board edge engaging channels overlapping said first and second boards to hold said sheet in place and to cover the edges of said boards and said sheet is cut to length to cover the length of said space.

22. The method of claim 21 wherein said step of defining the edges of said sheet with U-shaped board engaging receptacles.

23. The method of claim 21 wherein said receptacles have a throat with depth sufficient to grasp the edges of said first and second boards.

24. The method of claim 21 wherein the boards are cut by a saw to define said board edges and said board edges are irregular dependent on the saw cutting operation, and wherein said receptacles have a defined width sufficient to cover the saw cut edges.

* * * * *